US005357409A

United States Patent [19]

Glatt

[11] Patent Number: 5,357,409

[45] Date of Patent: Oct. 18, 1994

[54] ILLUMINATED SAFETY HELMET

[76] Inventor: Terry L. Glatt, 117 Lake Emerald Dr., Oakland Park, Fla. 33309

[21] Appl. No.: 31,294

[22] Filed: Mar. 12, 1993

[51] Int. Cl.[5] ..... F21L 15/12

[52] U.S. Cl. ..... 362/105; 362/184; 362/800

[58] Field of Search ..... 362/249, 800, 105, 184, 362/198, 106; 315/33, 76, 314

[56] References Cited

U.S. PATENT DOCUMENTS

| | | | |
|---|---|---|---|
| 2,971,082 | 6/1958 | Frank | 362/106 |
| 4,231,079 | 10/1980 | Heminover | 362/106 |
| 4,891,736 | 1/1990 | Gouda | 362/105 |
| 4,904,998 | 2/1990 | Niimi | 340/908.1 |
| 4,997,196 | 3/1991 | Wood | 362/800 |
| 5,113,325 | 5/1992 | Eisenbraun | 362/800 |
| 5,128,843 | 7/1992 | Guritz | 362/800 |

*Primary Examiner*—Ira S. Lazarus
*Assistant Examiner*—L. Heyman
*Attorney, Agent, or Firm*—Adduci, Mastriani, Schaumberg & Schill

[57] ABSTRACT

An illuminated safety helmet including a protective core and a plurality of light emitting diodes (LEDs) disposed around the protective core. The LEDs are sequentially illuminated by control circuitry. A housing encloses the control circuitry and a power source for powering the control circuitry and the LEDs. The housing is electrically connected to the LEDs and is removably attached to the protective core of the safety helmet. An impact resistant shell or a skin of stretchable material is disposed on the external or internal surface of the protective core.

20 Claims, 3 Drawing Sheets

BT1
3V
U2
CLK
ENA
RST
4022
Q0
Q1
Q2
Q3
Q4
Q5
Q6
Q7
CO
46
UIA
UIB
INV
4049
40
42
44
38
CR1
CR2
CR3
CR4
CR5
CR6
CR7
CR8
R1
R2
R3
R4
R5
R6
R7
R8
R11
R12
R13
R14
R15
R16
R17
R18
14
48
50
52
54

ILLUMINATED SAFETY HELMET

FIELD OF THE INVENTION

The present invention relates to safety devices for recreational and occupational activities and, more particularly, to an illuminated safety helmet.

BACKGROUND OF THE INVENTION

Safety helmets are used in a number of recreational and occupational activities including, for example, bicycling, motorcycling, skateboarding, in-line skating, and road construction work. When one of those activities is undertaken at night or during other low visibility conditions, it is important that the participant be visible to others, especially drivers of passing motor vehicles. If drivers cannot see the participant, then they may collide with the participant and inflict serious injury.

Conventional safety helmets have been provided with reflectors to make the wearer visible to others. The effectiveness of reflectors, however, is limited because they are passive devices that function only when subjected to an external source of illumination. The effectiveness of reflectors is further limited by the angle of incidence and the brightness of the external source of illumination. Consequently, there are many circumstances under which conventional safety helmets do not make the wearer adequately visible to others.

Accordingly, it is an object of the invention to provide an improved safety helmet that makes the wearer visible to others at night or during other low visibility conditions without jeopardizing the impact protection provided by the safety helmet.

Additional objects and advantages of the invention will be set forth in part in the description which follows, and in part will be obvious from the description, or may be learned by practice of the invention. The objects and advantages of the invention will be realized and attained by means of the instrumentalities and combinations particularly pointed out in the appended claims.

SUMMARY OF THE INVENTION

To achieve the objects and in accordance with the purpose of the invention, as embodied and broadly described herein, the illuminated safety helmet of the invention includes a protective core. A plurality of light emitting diodes ("LEDs") are disposed around the protective core. The LEDs are sequentially illuminated by control circuitry. A housing encloses the control circuitry and a power source for powering the control circuitry and the LEDs. The housing is electrically connected to the LEDs and is removably attached to the protective core of the safety helmet.

In the preferred embodiment of the invention, eight LEDs are substantially equally spaced around the periphery of the protective core in a generally circular pattern. The protective core includes a recessed portion in which a first half of an electrical connector is disposed. The housing, which has a second half of an electrical connector thereon, is disposed in the recessed portion of the protective core and is electrically connected to the LEDs by plugging the second half of the electrical connector into the first half.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DESCRIPTION OF THE PREFERRED EMBODIMENT

Reference will now be made in detail to the present preferred embodiments of the invention, examples of which are illustrated in the accompanying drawings.

Figure 1:
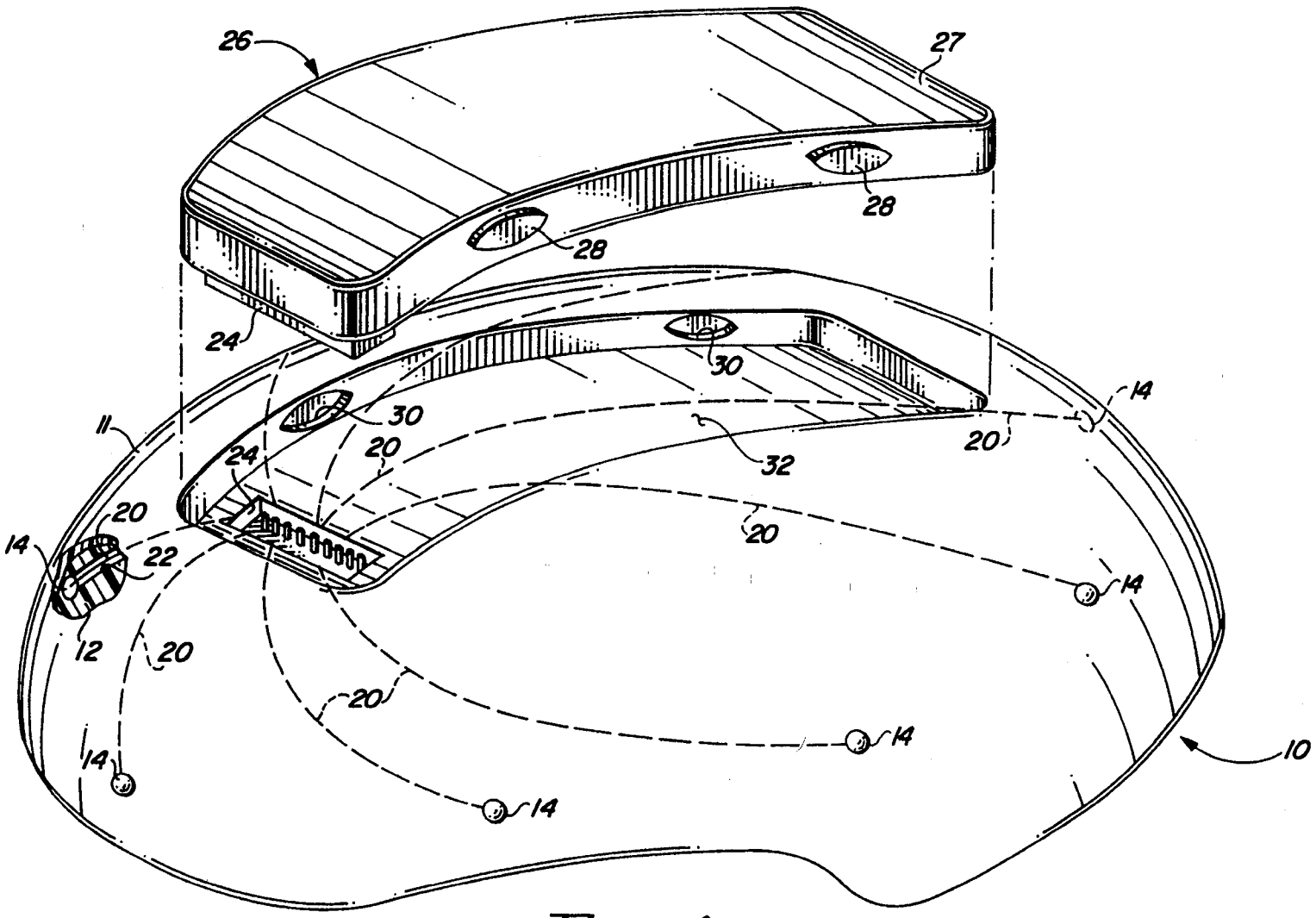
FIG. 1 is a perspective view of the illuminated safety helmet of the invention.

The preferred embodiment of the safety helmet of the invention is shown in FIG. 1 and is represented generally by numeral 10. The internal portion of protective core or body 12 is provided with protective foam padding 13 (see FIGS. 3 and 4) found in conventional safety helmets. Protective core 12 provides impact absorption and is made of styrofoam or other suitable material. As shown in FIG. 1, layer 11 is disposed on the external surface of protective core 12 to provide additional impact resistance. Those skilled in the art will recognize that most conventional safety helmets designed for recreational and occupational activities are suitable for use in the present invention.

In accordance with the invention, a plurality of LEDs are disposed around the protective core of the safety helmet. Referring to FIG. 1, LEDs 14 are disposed around the periphery of protective core 12. Commercially available LEDs are suitable for use in the invention. To maximize visibility, however, the LEDs should have an intensity of at least 1000 mcd and, preferably, 2000 mcd. Laser diodes also can be used in the invention. The beams emitted by the laser diodes would be rendered visible by moisture or dust in the air.

Figure 3:
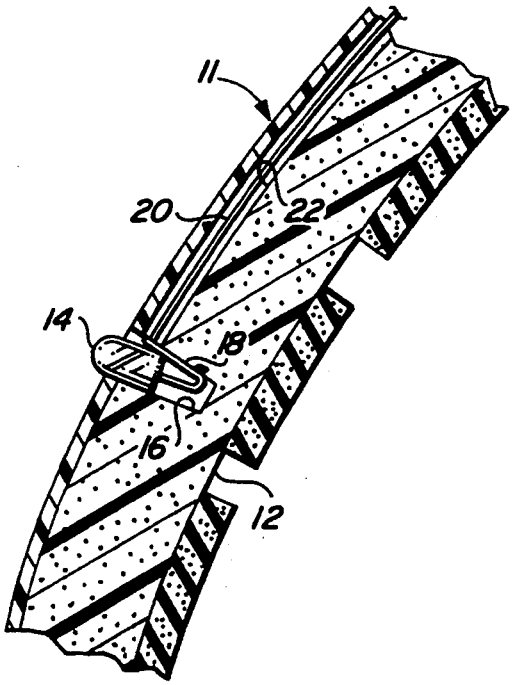
FIG. 3 is a cross-sectional view of an LED disposed in a hole that extends partially through the protective core of the safety helmet.
Figure 4:
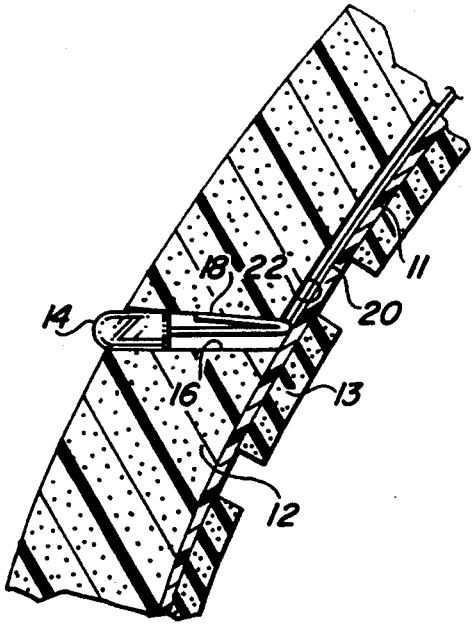
FIG. 4 is a cross-sectional view of an LED disposed in a hole that extends completely through the protective core of the safety helmet.

Two exemplary methods for mounting LEDs 14 around protective core 12 are shown in FIGS. 3 and 4. In the preferred method, and with reference to FIG. 3, LED 14 is disposed in hole 16 that extends partially through protective core 12. Alternatively, as shown in FIG. 4, LED 14 is disposed in hole 16 that extends completely through protective core 12. LEDs 14 shown in both FIGS. 3 and 4 are affixed in holes 16 using an adhesive such as epoxy. Alternatively, hole 16 may be a fitted hole into which LED 14 snaps or is held in place by contact 18.

It is preferred that at least four LEDs are disposed around the protective core. In the preferred embodiment shown in FIG. 1, eight LEDs 14 (not all of which can be seen in FIG. 1) are substantially equally spaced around the periphery of protective core 12 in a generally circular pattern. It will be apparent to those skilled in the art that both the number of LEDs and the positioning of the LEDs can be varied.

In accordance with the invention, the LEDs are sequentially illuminated by control circuitry. As shown herein, one of LEDs 14 is illuminated at a time in sequence around protective core 12 by the control circuitry shown in FIG. 5 and described in detail below. LEDs 14 are preferably illuminated in sequence at a rate at which they appear to be in motion. Such sequential illumination triggers a viewer's temporal response system, which is more sensitive in the periphery of the field of view, and results in earlier detection of a person wearing the safety helmet of the present invention.

Those skilled in the art are familiar with the frequencies required to sequentially illuminate LEDs so that they appear to be in motion. In general, the human eye will perceive that a light source is continuously illuminated at frequencies exceeding approximately 30 Hz.

Figure 2:
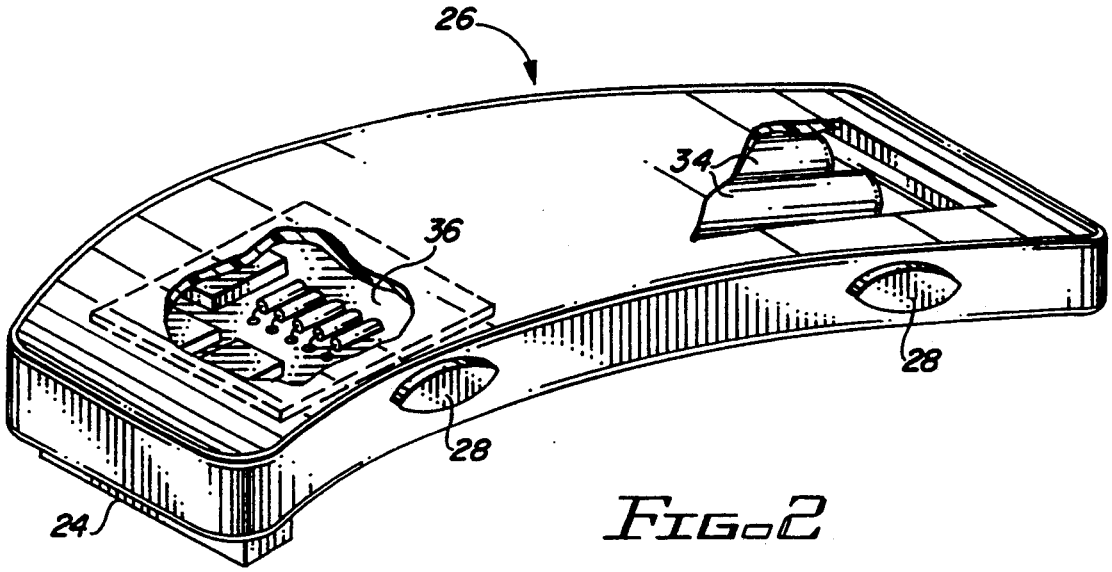
FIG. 2 is a cut-away view of the housing for enclosing the control circuitry and the power source.

A power source is provided to power the control circuitry and the LEDs. In the preferred embodiment, power is provided by batteries 34 as shown in FIG. 2. If desired, batteries 34 may be rechargeable.

Figure 5:
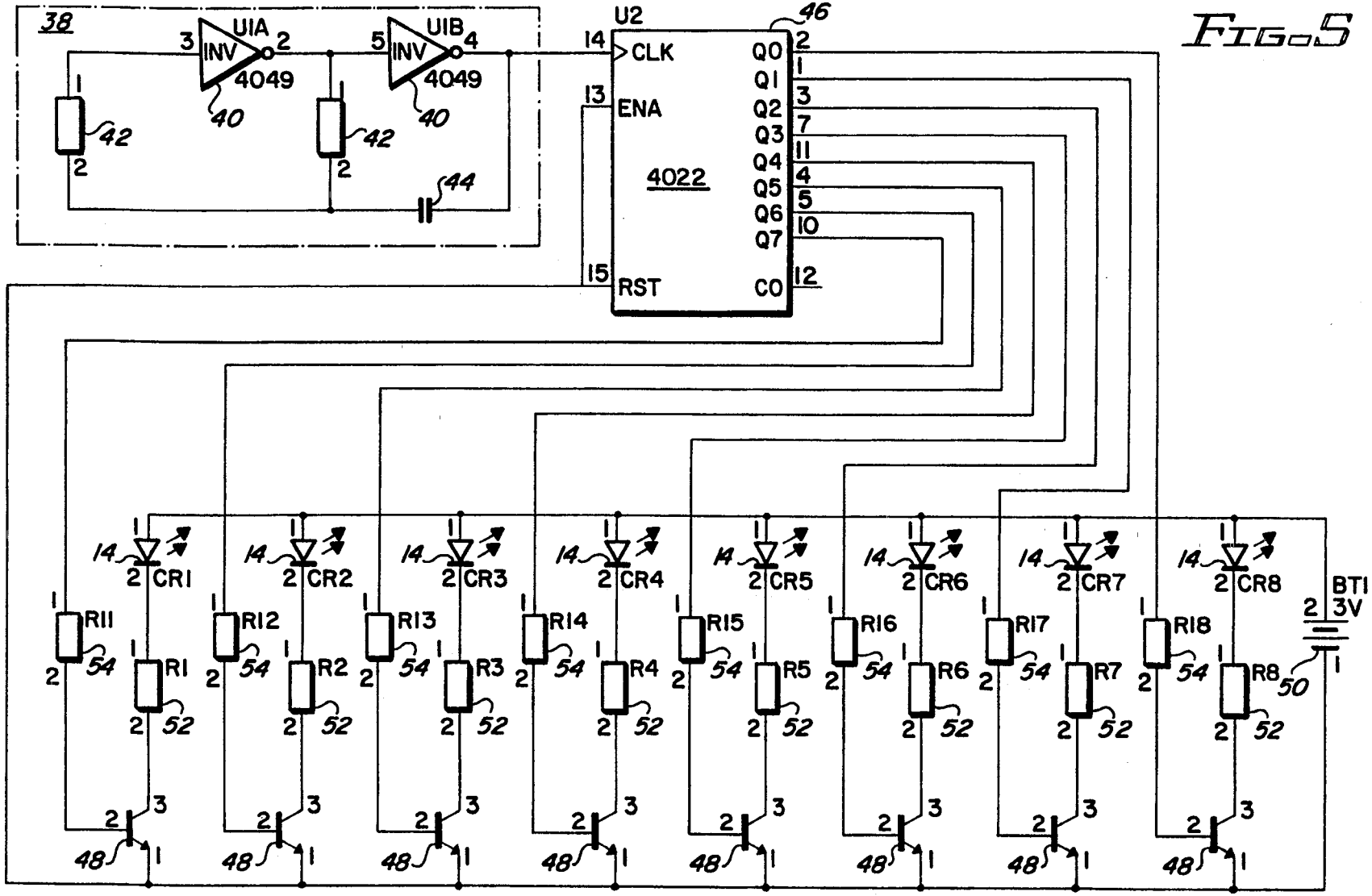
FIG. 5 is a schematic diagram of the preferred control circuitry for sequentially illuminating eight LEDs.

FIG. 5 is a schematic diagram of the preferred control circuitry for sequentially illuminating eight LEDs. Referring to FIG. 5, oscillator 38 is comprised of inverters 40 from a 4069 inverter package, resistors 42, and capacitor 44. Oscillator 38 sends a clock signal to ring counter 46. The frequency of ring counter 46 can be varied by adjusting resistors 42 and capacitor 44. The outputs of ring counter 46 each drive a transistor 48 configured as a common-emitter switch. LEDs 14 are connected in series with power source 50, current limiting resistor 52, and the collector for each transistor 48. When the base of one of the transistors 48 is driven high, i.e., to logic 1, through one of 3.8K ohm resistors 54, the corresponding LED 14 is illuminated.

It will be apparent to those skilled in the art that the control circuitry can be varied to illuminate more than one LED at a time. It will also be apparent that LEDs 14 can be disposed on protective core 12 in a different order than they are electrically connected to ring counter 46 to produce a different illumination pattern. For example, diametrically opposed LEDs could be sequentially illuminated in pairs to effect a "star" pattern around the helmet.

In accordance with the invention, a housing for enclosing the control circuitry and the power source is provided. Referring to FIG. 2, housing 26 encloses circuit board 36 and batteries 34. Housing 26 is preferably made of molded plastic but also can be made from other lightweight, weatherproof materials capable of protecting the control circuitry and the power source from rain, snow, and the like. The interior of housing 26 is preferably molded to securely accommodate circuit board 36 and batteries 34. In the preferred embodiment, housing 26 is disposed in recessed portion 32 of protective core 12 so that top surface 27 of housing 26 is flush with protective core 12 as can be appreciated in FIG. 1. The depth of recessed portion 32 should be selected to avoid jeopardizing the impact protection provided by helmet 10. Alternatively, housing 26 may be configured so that top surface 27 is either above or below the external surface of protective core 12.

In accordance with the invention, means for electrically connecting the housing to the LEDs is provided. As embodied herein, and with reference to FIGS. 1, 3, and 4, the electrical connection means includes connector 24 and wires 20. In the preferred embodiment, the female half of connector 24 is disposed in recessed portion 32 of protective shell 12 and is electrically connected to LEDs 14 by wires 20. Referring to FIG. 3, wire 20 is disposed in channel 22 formed in the external surface of protective core 12. Channel 22 is also visible in FIG. 1. Contact 18 is configured so that it extends out of hole 16 and is connected to wire 20. Wire 20 is retained in channel 22 by layer 11 disposed on the external surface of protective core 12. When additional impact resistance is desired, layer 11 is a thin shell (on the order of 1 mm–2 mm thick) formed of a hard, impact resistant polymeric material. Alternatively, when additional impact protection is not required, layer 11 is a thin skin of a stretchable material such as nylon. The male half of connector 24 is disposed on housing 26 and, as can be appreciated in FIGS. 2 and 5, is electrically connected to circuit board 36 and batteries 34. Housing 26 is electrically connected to LEDs 14 by plugging the male half of connector 24 into the female half of connector 24. It will be apparent to those skilled in the art that the male and female halves of connector 24 could be reversed so that the male half is disposed in recessed portion 32 and the female half is disposed on housing 26.

In the alternative embodiment shown in FIG. 4, contact 18 extends through hole 16 and is connected to wire 20 disposed in channel 22 formed in the internal surface of core 12. Wire 20 is retained in channel 22 by layer 11 disposed on the internal surface of protective core 12. As described in connection with the preferred embodiment shown in FIG. 3, layer 11 may be a hard, impact resistant shell or a skin of stretchable material.

In accordance with the invention, means for removably attaching the housing to the protective core is provided. As embodied herein, and with reference to FIG. 1, the removable attachment means includes snaps 28 provided on housing 26 and corresponding depressions 30 in the walls of recessed portion 32. Housing 26 is removably attached to protective core 12 by disposing it in recessed portion 32 so that snaps 28 fit into depressions 30. It is noted that the joint created when the male and female halves of connector 24 are plugged into one another also can contribute to keeping housing 26 attached to protective core 12.

Those skilled in the art will recognize that, if desired, the housing can be attached to a protective core that does not have a recessed portion. Those skilled in the art will also recognize that other equivalent structures for removably attaching the housing to the protective core including, but not limited to, screws, clips, magnets, or strips of VELCRO may be used in the invention.

When rechargeable batteries are used, the housing may be removed and plugged directly into a charger having an appropriate mating connector. The helmet may be used with the housing removed while the batteries are recharging.

If desired, an additional light source, such as an incandescent or halogen light, can be mounted on the front portion of the helmet to help illuminate the area in front of the wearer. The additional light source may be powered by electrically connecting it to the batteries in the housing. The batteries in the housing also may be used to power LED's or other light sources disposed elsewhere on the wearer. For example, the batteries in the housing could be connected to a vest worn with the helmet.

It will be apparent to those skilled in the art that various modifications and variations can be made in the illuminated safety helmet of the invention without departing from the scope of the invention as defined in the following claims.

What is claimed is:

1. An illuminated safety helmet, comprising:
a protective core for covering a portion of a wearer's head, said core being impact absorbent;
a plurality of light emitting diodes disposed around said core;
control circuitry configured to sequentially illuminate said light emitting diodes;
a power source for powering said control circuitry and said light emitting diodes;
a housing for enclosing said control circuitry and said power source;
means for electrically connecting said housing to said light emitting diodes; and
means for removably attaching said housing to said core.

2. The helmet of claim 1, wherein at least four light emitting diodes are disposed around said core.

3. The helmet of claim 1, wherein eight light emitting diodes are substantially equally spaced around the periphery of said core in a generally circular pattern.

4. The helmet of claim 1, wherein said housing is disposed in a recessed portion of said core.

5. The helmet of claim 1, wherein a layer is disposed on an external surface of said core.

6. The helmet of claim 5, wherein said layer is an impact resistant shell.

7. The helmet of claim 5, wherein said layer is a skin of stretchable material.

8. An illuminated safety helmet, comprising:
a protective core for covering a portion of a wearer's head, said core being impact absorbent;
a plurality of light emitting diodes disposed around said core;
control circuitry configured to sequentially illuminate said light emitting diodes;
a power source for powering said light emitting diodes and said control circuitry; and
a housing for enclosing said control circuitry and said power source, said housing being removably attached to said core.

9. The helmet of claim 8, wherein at least four light emitting diodes are disposed around said core.

10. The helmet of claim 8, wherein eight light emitting diodes are substantially equally spaced around the periphery of said core in a generally circular pattern.

11. The helmet of claim 8, wherein said housing is disposed in a recessed portion of said core.

12. The helmet of claim 8, wherein an external surface of said protective core has channels therein and a layer is disposed on said external surface of said core.

13. The helmet of claim 12, wherein said layer is an impact resistant shell.

14. The helmet of claim 12, wherein said layer is a skin of stretchable material.

15. An illuminated safety helmet, comprising:
a protective core, said core having a recessed portion in which a first half of an electrical connector is disposed;
a plurality of light emitting diodes disposed around said core, said light emitting diodes being electrically connected to said first half of said electrical connector;
control circuitry configured to sequentially illuminate said light emitting diodes;
a power source for powering said light emitting diodes and said control circuitry; and
a housing for enclosing said control circuitry and said power source removably attached to said core, said housing having a second half of said connector thereon and being disposed in said recessed portion of said shell, said second half of said connector being electrically connected to said control circuitry and said power source.

16. The helmet of claim 15, wherein at least four light emitting diodes are disposed around said core.

17. The helmet of claim 15, wherein eight light emitting diodes are substantially equally spaced around the periphery of said core in a generally circular pattern.

18. The helmet of claim 15, wherein an external surface of said protective core has channels therein for receiving wires electrically connecting said light emitting diodes to said electrical connector and a layer is disposed on said external surface of said core.

19. The helmet of claim 18, wherein said layer is an impact resistant shell.

20. The helmet of claim 18, wherein said layer is a skin of stretchable material.

* * * * *